US005108581A

United States Patent [19]

Aldridge et al.

[11] Patent Number: 5,108,581

[45] Date of Patent: * Apr. 28, 1992

[54] HYDROCONVERSION OF HEAVY FEEDS BY USE OF BOTH SUPPORTED AND UNSUPPORTED CATALYSTS

[75] Inventors: Clyde L. Aldridge; Roby Bearden, Jr.; William E. Lewis, all of Baton Rouge, La.

[73] Assignee: Exxon Research and Engineering Company, Florham Park, N.J.

[ * ] Notice: The portion of the term of this patent subsequent to Mar. 25, 2003 has been disclaimed.

[21] Appl. No.: 607,928

[22] Filed: Nov. 1, 1990

Related U.S. Application Data

[63] Continuation of Ser. No. 243,376, Sep. 12, 1988, abandoned, which is a continuation-in-part of Ser. No. 33,682, Apr. 3, 1987, Pat. No. 4,793,916, which is a continuation-in-part of Ser. No. 773,595, Sep. 9, 1985, abandoned, which is a continuation-in-part of Ser. No. 682,379, Dec. 17, 1984, abandoned.

[51] Int. Cl.[5] ..... C10G 47/02

[52] U.S. Cl. ..... 208/108; 208/110; 208/111; 208/112

[58] Field of Search ..... 208/108, 110, 111, 112, 208/420, 421

[56] References Cited

U.S. PATENT DOCUMENTS

| | | | |
|---|---|---|---|
| 4,111,787 | 9/1978 | Aldridge et al. | 208/10 |
| 4,134,825 | 1/1979 | Bearden, Jr. et al. | 208/108 |
| 4,226,742 | 10/1980 | Bearden, Jr. et al. | 208/55 |
| 4,548,700 | 10/1985 | Bearden, Jr. et al. | 502/28 |
| 4,549,957 | 10/1985 | Hensley, Jr. et al. | 208/216 PP |
| 4,569,752 | 2/1986 | Aldridge et al. | 208/53 |
| 4,578,182 | 3/1986 | Bearden, Jr. et al. | 208/112 |

*Primary Examiner*—Olik Chaudhuri
*Assistant Examiner*—G. Fourson
*Attorney, Agent, or Firm*—Henry E. Naylor

[57] ABSTRACT

Disclosed is a catalytic process for hydroconverting heavy hydrocarbonaceous feedstocks to lower boiling products wherein a catalyst precursor concentrate or catalyst concentrate is first prepared in a heavy oil medium then fed to a hydroconversion zone which may also contain a supported hydrotreating catalyst. The hydroconversion zone may be operated in either slurry or ebullating bed mode.

24 Claims, 2 Drawing Sheets

EFFECT OF CATALYST PRECURSOR CONCENTRATE MEDIUM COMPOSITION

HYDROCONVERSION OF HEAVY FEEDS BY USE OF BOTH SUPPORTED AND UNSUPPORTED CATALYSTS

CROSS REFERENCE TO RELATED APPLICATIONS

This is a continuation of application Ser. No. 243,376, filed Sept. 12, 1988, now abandoned, which is a continuation-in-part of U.S. Serial No. 033,682, filed Apr. 3, 1987, now U.S. Pat. No. 4,793,916, which is a continuation-in-part of Serial No. 773,595, Filed Sept. 9, 1985, now abandoned, which is a continuation-in-part of Serial No. 682,379, filed Dec. 17, 1984 now abandoned.

1. Field of the Invention

This invention relates to an improvement in a catalytic hydroconversion process utilizing both an unsupported metal-containing catalyst prepared from a catalyst precursor dispersed in a hydrocarbonaceous oil and a supported catalyst composition.

2. Description of Information Disclosures

There is substantial interest in the petroleum industry for converting heavy hydrocarbonaceous feedstocks to lower boiling liquids and gases. One type of process is a slurry process utilizing a catalyst prepared in a hydrocarbon oil from a thermally decomposable or oil soluble metal compound catalyst precursor. See, for example, U.S. Pat. Nos. 4,226,742 and 4,244,839.

It is also known to use such catalysts in hydroconversion processes (i.e., coal liquefaction) in which coal particles are slurried in a hydrocarbonaceous material. See, for example, U.S. Pat. Nos. 4,077,867 and 4,111,787.

Another type of process used for converting heavy feedstocks is a process wherein the feedstock is subjected to hydroconversion conditions in an expanded, or ebullating, bed of hydrotreating catalyst, such as Ni/Mo or Co/Mo on alumina. See, for example, U.S. Pat. Nos. 4,549,957 and 4,657,665.

The term "hydroconversion" as used herein refers to a catalytic process conducted in the presence of hydrogen in which at least a portion of the heavy constituents of a hydrocarbonaceous oil is converted to lower boiling products. It may also simultaneously reduce the concentration of nitrogenous compounds, and metallic constituents.

All boiling points referred to herein are atmospheric pressure equivalent boiling points unless otherwise specified.

It has been found that introducing a catalyst precursor mixed in relatively large amounts in a hydrocarbonaceous oil (i.e., catalyst precursor concentrate) into a hydroconversion zone containing a heavy hydrocarbonaceous chargestock has certain advantages when compared with a process wherein the catalyst precursor is introduced into the hydroconversion zone without first forming a concentrate; that is, by introducing the catalyst precursor directly into the feed in the reactor. The advantages include: (i) ease of mixing the precursor with a small stream instead of the whole feed; (ii) the ability to store the precursor concentrate for future use and/or activity certification; and (iii) the ability to use a hydrocarbonaceous oil, other than the feedstock, as dispersing medium for the catalyst precursor, which hydrocarbonaceous oil other than the feedstock can be more optimum for developing catalyst activity.

Further, it has now been found that pre-treating a catalyst precursor mixed in relatively large amounts with a hydrocarbonaceous oil (i.e., catalyst precursor concentrate) to convert the catalyst precursor to a solid catalyst in the oil, and subsequently introducing at least a portion of the resulting catalyst concentrate into the hydrocarbonaceous chargestock to be hydroconverted will provide certain advantages. Such advantages include greater flexibility of conditions, for example, use of higher concentrations of sulfiding agent than the concentrations that would be used to treat the total charge-stock, flexibility of heat balance, and economy of energy. Treatment of only the catalyst precursor concentrate also permits reduction of size of equipment needed compared to treatment of the catalyst precursor in the total chargestock. Furthermore, preparing a catalyst concentrate permits storing the catalyst concentrate to use as needed on-site or to send to another site.

SUMMARY OF THE INVENTION

In accordance with the present invention there is provided a process for converting heavy hydrocarbonaceous feedstocks to lower boiling products. The process comprises:

(a) forming a mixture of a heavy hydrocarbonaceous oil and a dispersible, or decomposable, metal compound, said metal being selected from the group consisting of Groups II, III, IV, V, VIB, VIIB, and VIII and mixtures thereof of the Periodic Table of the Elements;

(b) introducing at least a portion of said mixture into a hydroconversion zone containing a heavy hydrocarbonaceous chargestock and a supported catalyst comprised of: (i) a metal selected from Groups VIB and VIII of the Periodic Table of the Elements; and (ii) a refractory inorganic support material;

(c) subjecting the chargestock and catalysts to a temperature of about 700° to 900° F., in the presence of a hydrogen-containing gas, and a hydrogen partial pressure from about 100 to 5000 psig, thereby producing lower boiling products.

In a preferred embodiment of the present invention, prior to introducing the mixture of step (a) into the hydroconversion zone, it is first heated in the presence of a sulfiding agent at a temperature of at least about 500° F. for an effective amount of time to convert the oil-dispersible or decomposable, metal compound to the corresponding metal-containing catalyst in said hydrocarbonaceous oil.

In preferred embodiments of the present invention, the sulfiding agent is selected from the group consisting of hydrogen sulfide, a blend of hydrogen and hydrogen sulfide, elemental sulfur, carbon disulfide and compounds that decompose to yield sulfur moieties which will react with the catalyst precursor. Also suitable are plant streams containing hydrogen sulfide in mixture with other gases, and sulfur-rich hydrocarbon media containing more than 0.1 wt. % sulfur.

In still other preferred embodiments of the present invention, the sulfiding agent is hydrogen sulfide which is present in a ratio of $H_2S$ to elemental metal of from about 1 to 5.

In other preferred embodiments of the present invention, the concentration of oil dispersible metal compound is such that the concentration of metal is from about 0.1 to 2 wt. %, calculated as elemental metal.

In yet other preferred embodiments of the present invention the oil-dispersible metal compound is selected from the group consisting of inorganic metal compounds, salts of organic acids, organo-metallic compounds, salts of organic amines, and mixtures thereof.

In still other preferred embodiments of the present invention the oil-dispersible metal compound is a phosphosmolybdic acid, and the hydroconversion is conducted in an expanded bed of supported catalyst comprised of Ni/Mo on alumina or Co/Mo on alumina.

DESCRIPTION OF THE PREFERRED EMBODIMENT

Figure 1:
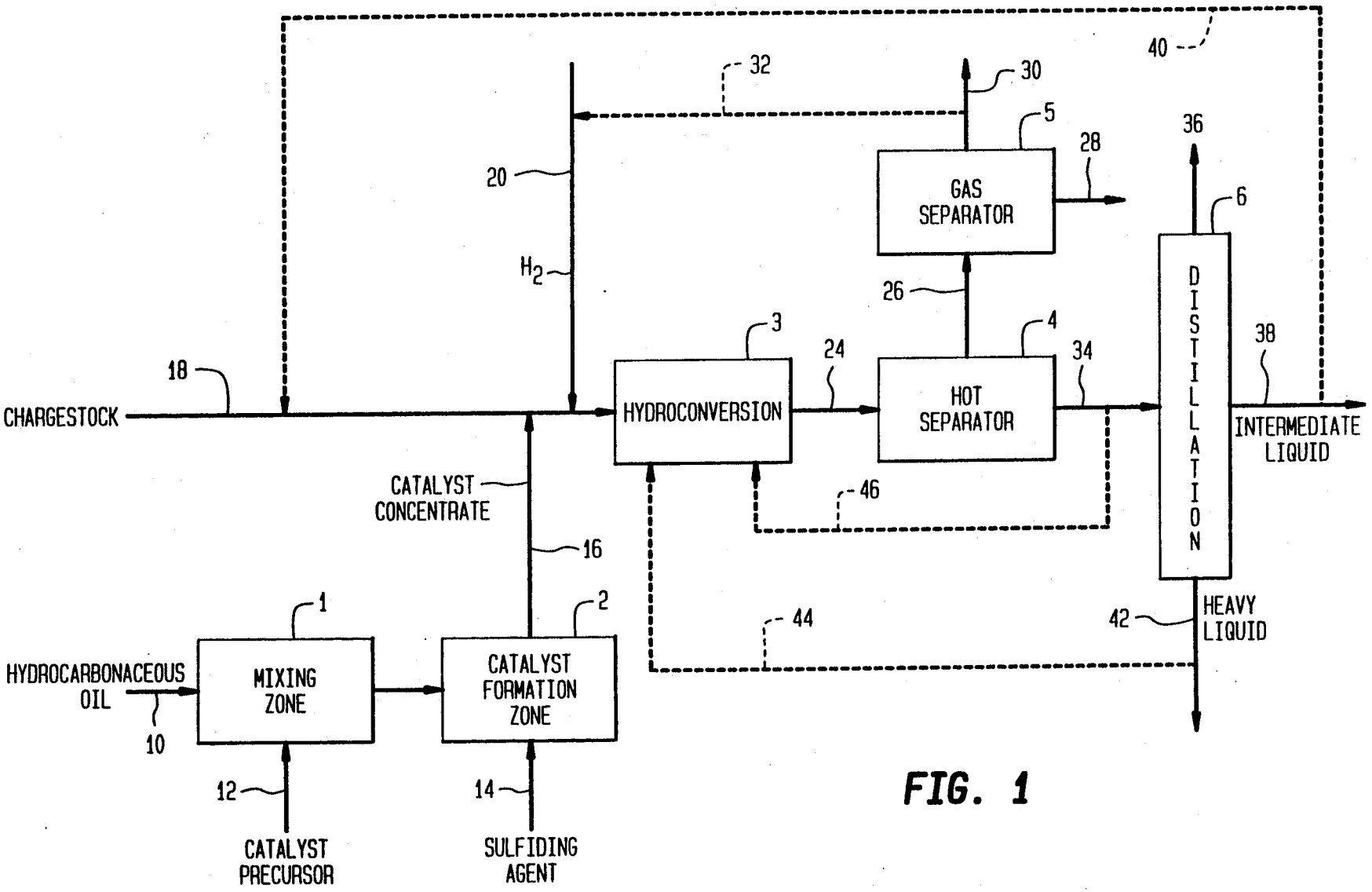
FIG. 1 is a schematic flow plan of one embodiment of the invention.
Figure 2:
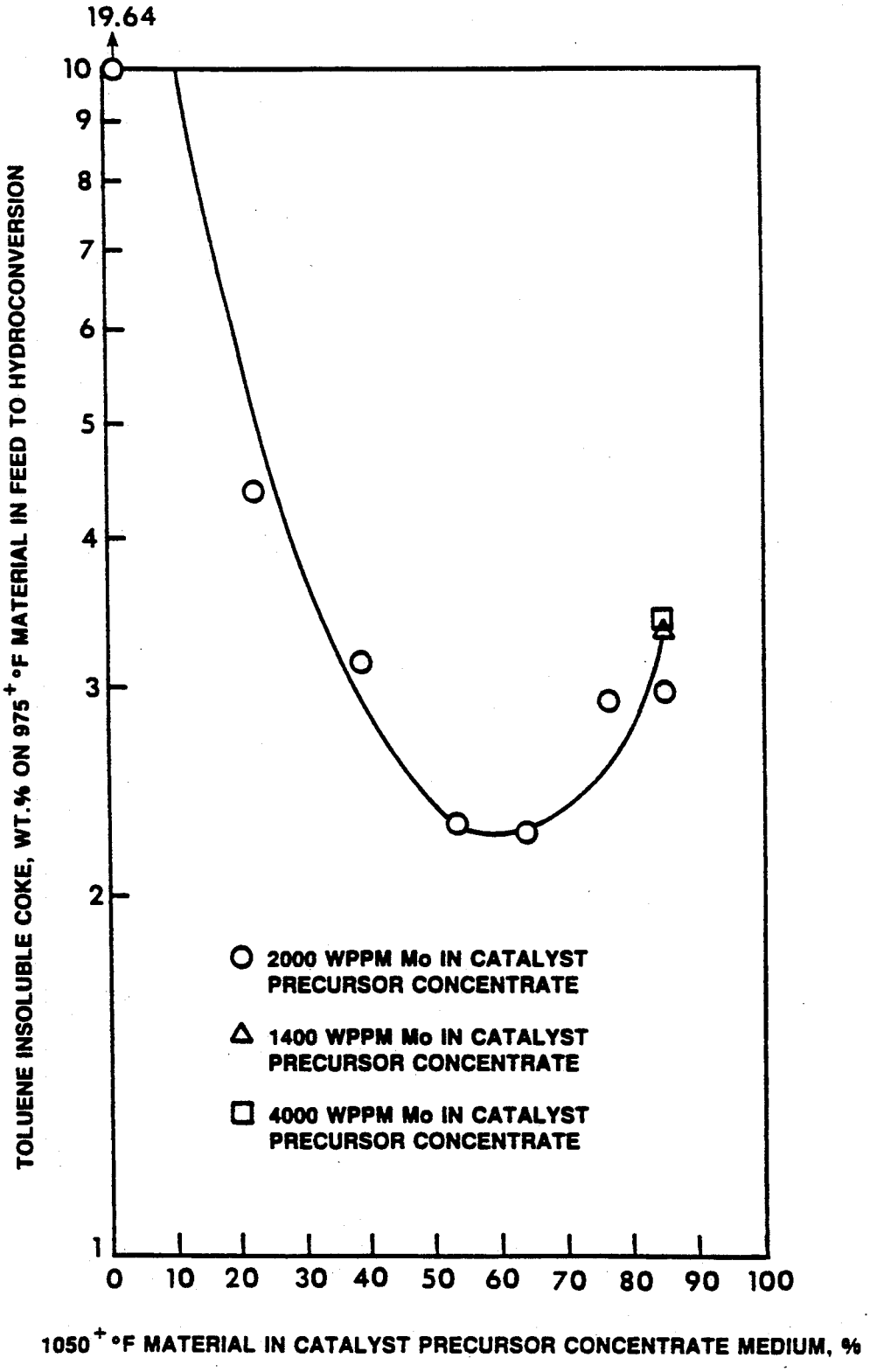
FIG. 2 is a plot of toluene insoluble coke vs. catalyst precursor concentrate composition. The plot demonstrates the advantages of employing a precursor concentrate containing from about 22 to 85 wt.% heavier oil with the balance being lighter oil

Referring to FIG. 1 hereof, a heavy hydrocarbonaceous oil is introduced by line 10 into mixing zone 1. Suitable heavy hydrocarbonaceous oils for introduction into mixing zone 1, include hydrocarbonaceous oils comprising constituents boiling above about 1050° F., preferably—having at least 10 weight percent constituents boiling above about 1050° F., such as crude oils, atmospheric residua boiling above about 650° F., and vacuum residua boiling above about 1050° F. Preferably, the hydrocarbonaceous oil has an initial boiling point above at least 650° F. and comprises asphaltenes Instead of using one zone, such as mixing zone 1 as both mixing and catalyst formation zone, a separate catalyst formation zone 2 or vessel 2, can be used after mixing zone 1, to prepare the catalyst (i.e., convert the catalyst precursor to the solid catalyst). Most preferably, the hydrocarbonaceous oils comprise a lighter boiling oil boiling below about 1050° F. and a heavier oil boiling above about 1050° F. in a blend comprising at least about 10 weight percent, preferably at least about 22 weight percent materials boiling above 1050° F. Preferred concentrations of the 1050+° F. fraction in the blend include from 22 to 85 weight percent heavier oil, more preferably about 30 to 85 weight percent heavier oil, still more preferably about 40 to 85 weight percent heavier oil, and most preferably about 45 to 75 weight percent heavier oil, based on the total weight of the blend (mixture of oils). The light oil may be a gas oil and the heavier oil may be a vacuum residuum. Alternatively, an atmospheric residuum having the appropriate amount of desired constituents may be used as the oil of line 10. The hydrocarbonaceous oil carried in line 10 may be derived from any source such as petroleum, tarsand oil, shale oil, liquids derived from coal liquefaction processes, and mixtures thereof. Generally these oils have a Conradson carbon content ranging from about 5 to about 50 weight percent (as to Conradson carbon content see ASTM Test D 189-65). An oil dispersible, or decomposable, metal compound (catalyst precursor) is introduced into mixing zone 1 by line 12. The oil-dispersible metal compound may be a compound that is soluble in the hydrocarbonaceous oil or a compound that is soluble in an organic compound (liquid medium) that can be dispersed in the hydrocarbonaceous oil or a compound that is water soluble and the aqueous solution dispersed in the hydrocarbonaceous material. For example, the oil dispersible metal compound introduced by line 12 may be in a phenolic medium, in water, in alcohol, etc. Suitable oil dispersible metal compounds convertible (under preparation conditions) to solid, metal-containing catalysts include: (1) inorganic metal compounds such as carbonyls, halides, oxyhalides; polyacids such as isopolyacids and heteropolyacids (e.g., phosphomolybdic acid, and molybdosilicic acid); (2) metal salts of organic acids such as acyclic and cyclic aliphatic carboxylic acids and thiocarboxylic acids containing two or more carbon atoms (e.g., naphthenic acids); aromatic carboxylic acids (e.g., toluic acid); sulfonic acids (e.g., toluenesulfonic acid); sulfinic acids; mercaptans; xanthic acids; phenols, di- and polyhydroxy aromatic compounds; (3) organometallic compounds such as metal chelates, e.g., with 1,3-diketones, ethylenediamine, ethylenediaminetetraacetic acid, phthalocyanines, etc.; (4) metal salts of organic amines such as aliphatic amines, aromatic amines and quatenary ammonium compounds.

The metal constituent of the oil dispersible metal compound that is convertible to a solid, metal-containing catalyst is selected from the group consisting of Groups II, III, IV, V, VIB, VIIB and VIII, and mixtures thereof of the Periodic Table of the Elements. Non-limiting examples include zinc, antimony, bismuth, titanium, cerium, vanadium, niobium, tantalum, chromium, molybdenum, tungsten, manganese, rhenium, iron, cobalt, nickel and the noble metals including platinum, iridium, palladium, osmium, ruthenium, and rhodium The preferred metal constituent of the oil dispersible compound is selected from the group consisting of molybdenum, tungsten, vanadium, chromium, cobalt, titanium, iron, nickel and mixtures thereof. Preferred compounds of the given metals include the salts of acyclic (straight or branched chain) aliphatic carboxylic acids, salts of cyclic aliphatic carboxylic acids, polyacids, carbonyls, phenolates and organoamine salts.

The Periodic Table of Elements referred to herein is published by Sergeant-Welch Scientific Company being copyrighted in 1979 and available from them as Catalog Number S-18806. Such oil dispersible metal compounds are described in U.S. Pat. No. 4,295,995, the teachings of which are incorporated herein by reference. The preferred oil dispersible metal compounds are inorganic polyacids of metals selected from Groups VA, VIA, and mixtures thereof, that is, vanadium, niobium, chromium, molybdenum, tungsten and mixtures thereof Suitable inorganic polyacids include phosphomolybdic acid, phosphotungstic acid, phosphovanadic acid, silicomolybdic acid, silicotungstic acid, silicovanadic acid and mixtures thereof. The preferred polyacid is a phosphomolybdic acid. The terms "heteropolyacids" and "isopolyacids" are used herein in accordance with the definitions given in *Advanced Inorganic Chemistry*, 4th Edition, by S.A. Cotton and Geoffrey Wilkinson, Interscience Publishers, N.Y., pages 852–861.

Referring to the figure, a sulfiding agent is introduced into catalyst formation zone 2 by line 14. The sulfiding agent is selected from the group consisting of a hydrogen sulfide containing gas, elemental sulfur, or a compound that decomposes to provide sulfur for reaction with the metal of the catalyst precursor. Non-limiting examples of such compounds include mercaptans, thioethers, dithioethers, and carbon disulfide. Also suitable are plant streams containing hydrogen sulfide in mixture with other gases and sulfur-rich hydrocarbonaceous media such as petroleum residua containing more than 0.1 wt. % sulfur, in particular, crude oil, and atmospheric and vacuum residua. Of course, if zone 1 serves as both the mixing zone and the catalyst formation zone, then the sulfiding agent is introduced into zone 1. Preferably the sulfiding agent comprises hydrogen sulfide or a mixture of hydrogen and hydrogen sulfide comprised of at least about 1 mole % hydrogen sulfide, based on the total mixture. It is also preferred that the $H_2S$/metal ratio be from about 1 to 5.

It is to be understood that in those cases where the hydrocarbon medium in the catalyst precursor concentrate contains reactive sulfur moieties in a sulfur to metal ratio of at least 1 to 1, neither extraneous sulfiding agents nor hydrogen need be introduced in catalyst preparation zone 2.

It is also to be understood that in those cases where the catalyst precursor concentrate of zone 1 is converted to a catalyst concentrate prior to introduction into the hydroconversion zone, or when it is fed directly into the hydroconversion zone, without first forming a catalyst concentrate, but the chargestock itself contains at least the required stoichiometric amount of sulfur moieties that will react with the catalyst precursor, then extraneous sulfiding agent need not be introduced into the hydroconversion zone.

A sufficient amount of the oil dispersible metal compound (catalyst precursor) is introduced into mixing zone 1 to form a catalyst precursor concentrate, that is, a mixture comprising from 0.1 to 2, preferably from 0.2 to 2, more preferably from about 0.2 to 1, and most preferably from 0.3 to 1, weight percent metal, calculated as elemental metal, based on the weight of the hydrocarbonaceous oil in the mixture. The mixture of oil dispersible metal compound and hydrocarbonaceous oil (catalyst precursor concentrate) is heated in catalyst formation zone 2 to a temperature sufficient to convert the oil dispersible metal compound (catalyst precursor) to the corresponding metal-containing solid catalyst. Suitable catalyst formation conditions include a temperature of at least about 500° F., preferably a temperature ranging from 500° F. to 850° F., more preferably from about 650° F. to 780° F., most preferably from about 680° F. to 730°F., and a total pressure ranging from atmospheric to 5000 psig, preferably a pressure ranging from 10 to 2000 psig to convert the oil dispersible metal compound to a solid catalyst comprising the metals corresponding to the metals of the catalyst precursor. The resulting catalyst concentrate (solid catalyst particles dispersed in the hydrocarbon oil) is removed by line 16 from catalyst formation zone 2. Of course, the precursor concentrate of mixing zone 1 can be fed directly into line 18, or into hydroconversion zone 3, as long as enough sulfiding agent is present in the feedstock, or independently added to the feedstock or hydroconversion zone, to convert the precursor concentrate to the correspondend catalyst concentrate.

At least a portion of the catalyst concentrate is introduced, via line 16, into line 18 which carries a hydrocarbonaceous oil chargestock and is dispersed in the oil chargestock. Suitable hydrocarbonaceous chargestocks include crude oils, mixtures of hydrocarbons boiling above 430° F., preferably above 650° F., for example, gas oils, vacuum residua, atmospheric residua, and once through coker bottoms. The hydrocarbonaceous oil may be derived from any source such as petroleum, shale oil, tarsand oil, oils derived from coal liquefaction processes, including coal liquefaction bottoms, and mixtures thereof. Preferably, the hydrocarbonaceous oils have at least 10 weight percent material boiling above 1050° F. More preferably, the hydrocarbonaceous oils have a Conradson carbon content ranging from about 5 to about 50 weight percent.

A hydrogen-containing gas is introduced by line 20 into line 18. The mixture of hydrocarbonaceous chargestock, catalyst concentrate, and hydrogen is passed by line 18 into hydroconversion zone 3. The catalyst concentrate of line 16 is added to the hydrocarbonaceous chargestock in an amount sufficient to provide from about 10 to about 2000 wppm metal, preferably from about 50 to about 1000 wppm metal, more preferably from about 50 to about 300 wppm metal, calculated as elemental metal, based on the total hydroconversion zone chargestock, i,e., concentrate plus hydrocarbonaceous chargestock.

It is to be understood that the figure hereof is a general description of one preferred process scheme and that the components represented by lines such as 16, 20, and the line showing intermediate liquid recycle, of line 40, can be introduced directly into the hydroconversion zone 3 instead of into feedstock line 18.

For purposes of the present invention, the hydroconversion of zone 3 can be accomplished by either a slurry technique or by an expanded (ebullated) bed technique. If operated as a slurry, then supported catalyst need not be present. Suitable slurry hydroconversion operating conditions are summarized below.

| Conditions | Broad Range | Preferred Range |
|---|---|---|
| Temperature, °F. | 700 to 900 | 820 to 870 |
| Hydrogen Partial Pressure, psig | 100 to 5000 | 300 to 3000 |

If an ebullated bed process is used, the hydroconversion zone may contain one or more reactors which contain an expanded bed of supported hydro-treating catalysts. In expanded bed processes, a packed bed of supported catalysts is expanded and modified by upflow of hydrocarbonaceous feed and hydrogen-containing gas at space velocities effective to provide adequate mobilization and expansion, and thereby promote contact between catalyst particles and reactants, without substantial carryover of supported catalyst particles Bulk density of the supported catalyst is important from the standpoint of attaining appropriate bed expansion and mobilization at economically practical space velocities. Catalyst particle size and shape are also important in this regard. Preferred catalysts for expanded bed use are extrudates of about 0.02 to about 0.05 inch diameter, with about 1/32-inch being preferred. A preferred expanded bed process, particularly for treatment of high metals or high metals and sulfur content feeds is an ebullated bed process. In such processes, catalyst is preferably present in an amount sufficient to occupy at least about 10 volume % of the expanded bed and is continuously added to the reaction zone to compensate for spent catalyst which is continuously withdrawn. Specific details with respect to ebullated bed processes are found in U.S. Pat. Nos. 4,549,957; 3,188,286; 3,630,887; 2,987,465; 2,987,465 and Re. 25,770, all of which are incorporated herein by reference.

The hydrocarbonaceous oil is contacted with hydrogen in the ebullating bed of supported hydrotreating catalyst also at the above mentioned hydroconversion temperatures and pressures and at a hydrogen flow rate of about 1000 to about 20,000 SCFB (standard cubic feet per barrel measured at 15.6° C. and 101.3 kPa), preferably from about 1,000 to 10,000 SCFB, and LHSV (liquid hourly space velocity) of about 0.08 to about 1.5 volumes of hydrocarbonaceous oil per hour per volume of reactor. Preferred operating conditions comprise an average temperature of about 730° to about 850° F., total pressure of about 1,000 to about 3,000 psig, hydrogen partial pressure of about 1,000 to about 2,000 psia, hydrogen flow rate of about 8,000 SCFB, and LHSV of about 0.10 to about 0.8 volumes of hydrocarbons per hour per volume of reactor.

It is also within the scope of this invention to employ a multi-stage hydroconversion process wherein the metals content of the feed is reduced in a first stage followed by one or more subsequent stages in which a catalyst having high hydrodesulfurization activity is used. Individual stages can be conducted in single or multiple zones. Hydrodesulfurization catalysts particularly suited for use in a multi-stage process are those catalysts disclosed in U.S. Pat. Nos. 4,181,602; 4,321,729; 4,224,144; 4,297,242; and 4,306,965; all of which are incorporated herein by reference. U.S. Pat. No. 4,549,957, which is also incorporated herein by reference, teaches a catalyst particularly suited for a first stage where demetallation activity is preferred.

The hydrotreating supported catalysts of the present invention can be any catalyst suitable for hydrotreating purposes. That is, for the removal of undesirable species of the oil such as metals, sulfur, and nitrogen Such catalysts contain an active component and an inorganic refractory support material. The active component may be a metal or an oxide of a metal selected from Groups VIII or VIB of the Periodic Table of the Elements, or a combination thereof. The active component is deposited on, or admixed with, the inorganic refractory support, preferably an oxide, such as silica, alumina, or silica-alumina. The supported catalyst is subject to much variation and consequently may be a sulfided cobalt or nickel-molybdenum-alumina catalyst, etc. Other possible carrier materials include zirconia, titania, bauxite, and bentonite. Preferred supported catalysts are nickel-molybdenum on alumina and cobalt-molybdenum on alumina. The preparation of such catalysts is well known in the art and will not be discussed in detail herein.

Returning now to the figure, the hydroconversion zone effluent is removed from hydroconversion zone 3 by line 24 and passed to a hot-separator zone 4. The overhead of the hot separator is passed by line 26 to gas separator 5. A light liquid hydrocarbon stream is removed from the gas separator by line 28. A gas, which comprises hydrogen, is removed by line 30 and a portion of it, preferably after removal of undesired constituents; may be recycled via lines 32 and 20. The normally liquid phase, which comprises unsupported catalytic solids in a hydroconverted hydrocarbonaceous oil product, is passed by line 34 to distillation zone 6 for fractionation by conventional means such as distillation into various fractions such as light, medium boiling and heavy bottoms fractions. The light fraction is removed by line 36. If desired, solids may be removed from stream 34 prior to introduction into the distillation zone. An intermediate liquid hydrocarbonaceous stream is removed from distillation zone 6 by line 38; at least a portion of this stream may be recycled via line 40. A heavy liquid hydrocarbonaceous stream, which may comprise solids (if the solids were not previously removed) is removed from the distillation via line 42. If desired, a portion of this stream from line 42 may be recycled to the hydroconversion zone via line 44 or to mixing zone 1, or to lines 16 or 18 by lines not shown. Further, if desired, at least a portion of stream 34 may be recycled to the hydroconversion zone via line 46 and/or to mixing zone 1 either with or without intervening removal of solids. Furthermore, if desired, at least a portion of the solids removed from any of the hydroconversion effluent streams may be recycled to hydroconversion zone 3 or to mixing zone 1.

The following examples are presented to illustrate the invention.

Catalyst Precursor Concentrate Preparation A (Run 410L)

To a one liter Autoclave Engineers magnetically stirred autoclave was charged 300 g of Cold Lake Crude together with 46.16 g of a 2.5 wt. % solution of $CrO_3$ in water. The autoclave was flushed with nitrogen and heated to 121° C. with stirring and with a flow of 3 liter/min. of nitrogen. After reaching 121° C. the nitrogen stripping was continued for 30 minutes to remove all of the water. The autoclave was cooled and discharged to yield a catalyst precursor concentrate containing 2000 wppm Cr.

Catalyst Concentrate Preparation B (Run 412L)

A catalyst precursor concentrate was prepared according to the procedure of Preparation A, and, after cooling, the concentrate was given a treatment as follows.

The autoclave was flushed with $H_2$, then pressured to 125 psig with $H_2S$, and then pressured to 1250 psig with $H_2$ at room temperature. The autoclave was then heated to 380° C. with stirring and maintained at 380° to 385° C. for 30 minutes, then cooled, depressured and discharged to yield an activated catalyst concentrate containing 2000 wppm Cr.

Catalyst Concentrate Preparation C (Run 318L)

To a one liter Autoclave Engineers autoclave was charged 392 g of Heavy Arabian atmospheric residuum and 8.00 g. of a 20 wt. % solution of phosphomolybdic acid in phenol. The autoclave was flushed with $H_2$, then pressured to 125 psig with $H_2S$ and to 1250 psig with hydrogen. The autoclave was then heated to 380° C. with stirring and held at 380° C. to 385° C. for 30 minutes, after which it was cooled and discharged to yield an activated catalyst concentrate containing 2000 wppm Mo.

Example 1 (Run 1079)

To a 300 cc Autoclave Engineers magnetically stirred autoclave was charged 93.0 g. of Heavy Arabian vacuum residuum, 12.0 g. of Heavy Arabian atmospheric residuum and 15.0 g. of catalyst concentrate "B". The chromium concentration in this mixture was 250 wppm. The autoclave was flushed with $H_2$, pressured to 100 psig with $H_2S$ then to 1550 psig with hydrogen at room temperature The autoclave was then heated with stirring to 830° F., whereupon the pressure was adjusted to 2200 psig and these conditions maintained for 3 hrs while flowing hydrogen to the autoclave so as to maintain an exit gas flow of 0.26 l./min. as measured at room temperature with a wet test meter. The autoclave was cooled and depressured. The gases were collected and analyzed by mass spectrometry to determine gas formation. The autoclave contents were recovered in toluene solution and filtered to isolate the solids, which solids were washed with toluene and dried for 1 at 100° C.

The toluene solution of liquid product was distilled by 15/5 distillation to remove the solvent and light liquid followed by a Hivac-C distillation to isolate the unconverted 975+° F. material. The 975+° F. material was analyzed for Conradson carbon to determine the Conradson carbon conversion.

By these means the toluene insoluble coke yield based on the 975+° F. content of the charge was determined to be 2.78 wt. %, the 975+° F. conversion 87.4%, the $C_1$–$C_3$ gas yield on total feed 6.77%, and the Conradson carbon conversion to oil + gas 58.9%.

Example 2 (Run 1066)

An experiment was conducted according to the procedure of Example 1, except that the catalyst precursor concentrate of Preparation "A" was used.

The toluene insoluble coke yield based on the 975+° F. content of the charge was 3.61%, the 975+° F. conversion 83.9%, the $C_1$–$C_3$ gas yield on total feed 7.63%, and the Conradson carbon conversion to oil + gas 51.9%.

Example 3 (Run 927)

An experiment was carried out according to the procedure of Example 1, except that the activated catalyst concentrate of Preparation "C" was used.

The toluene insoluble coke yield based on the 975+° F. content of the charge was 2.35 wt. %, the 975+° F. conversion 85.2%, the $C_1$–$C_3$ gas make on total feed 7.17%, and the Conradson carbon conversion to oil + gas 56%.

The results of these experiments are shown in Table I.

TABLE I

| | Example 1 | Example 2 | Example 3 |
|---|---|---|---|
| Toluene Insoluble Coke, Wt. % on 975+° F. Material in Feed | 2.78 | 3.61 | 2.35 |
| Conversion of 975+° F. Material in Feed to 975−° F. Product | 87.4 | 83.9 | 85.2 |
| $C_1$–$C_3$ Gas, Wt. % on Total Feed | 6.77 | 7.63 | 7.17 |
| Con. Carbon Conversion to Oil + Gas, % | 58.9 | 51.9 | 56.0 |

Catalyst Precursor Concentrate Preparation D (Run 424L)

A catalyst precursor concentrate was prepared according to the procedure of preparation "A" except that Heavy Arabian atmospheric residuum was used as the hydrocarbon medium rather than Cold Lake crude.

Catalyst Concentrate Preparation E (Run 426L)

A catalyst precursor concentrate was prepared according to the procedure of preparation "D", and, after cooling, the concentrate was given a treatment as follows.

The autoclave was flushed with $H_2$, then pressured to 150 psig with $H_2S$, and then pressured to 1400 psig with $H_2$ at room temperature. The autoclave was then heated to 380° C. with stirring and maintained at 380° C. to 385° C. for 30 minutes, the cooled, depressured and discharged to yield an activated catalyst concentrate containing 2000 wppm Cr.

Example 4 (Run 1117)

To a 300 cc Autoclave Engineers magnetically stirred autoclave was charged 105.0 g. of topped Cold Lake crude and 15.0 g. of catalyst precursor concentrate "D". The chromium concentration in this mixture was 250 wppm. The autoclave was flushed with $H_2$, pressured to 50 psig with $H_2S$ then to 1400 psig with hydrogen at room temperature.

The autoclave was then heated with stirring to 380° C. and held at 380° C. to 385° C. for 20 min at which time the autoclave was further heated to 443° C., whereupon the pressure was adjusted to 2100 psig and these conditions maintained for 3 hrs while flowing hydrogen to the autoclave so as to maintain an exit gas flow of 0.36 liter/min. as measured at room temperature with a wet test meter. The autoclave was cooled and depressured The gases were collected and analyzed by mass spectrometry to determine gas formation. The autoclave contents were recovered in toluene solution and filtered to isolate solids, which solids were washed with toluene and dried for 1 hr in a vacuum oven at 100° C.

The toluene solution of liquid product was distilled by 15/5 distillation to remove the solvent and light liquid followed by a Hivac-C distillation to isolate the unconverted 975+° F. material.

By these means the toluene insoluble coke yield based on the 975+° F. content of the charge was determined to be 5.28 wt. %.

Example 5 (Run 1118)

An experiment was conducted according to the procedure of Example 4 except that the catalyst concentrate of Preparation "E" was used.

The toluene insoluble coke yield based on the 975+° F. content of the charge was 1.95%.

Catalyst Precursor Concentrate Preparations F–L

To a 1 liter magnetically stirred autoclave was charged 392 g of a hydrocarbonaceous medium comprised of various percentage compositions of 1050−° F. fraction and 1050+° F. fraction as set forth in Table II below. These compositions were prepared by blending together the requisite proportions of Heavy Arabian vacuum gas oil and Heavy Arabian vacuum residuum. The autoclave was flushed with nitrogen and heated with stirring to 335° F. At this temperature, 8.0 g. of 20 wt. % MCB phosphomolybdic acid in phenol was injected and stirring continued for 40 min., after which the autoclave was cooled and discharged to give a catalyst precursor concentrate containing 2000 wppm Mo.

Catalyst Precursor Concentrate Preparation M (Run 379L)

A catalyst precursor concentrate containing 1400 wppm Mo was prepared according to the procedure of preparations F–L except that 394.4 g of a heavy oil blend containing 85.4 wt. % material boiling above 1050° F. and 5.6 g of 20 wt. % MCB phosphomolybdic acid in phenol was employed.

Catalyst Precursor Concentrate Preparation N (Run 376L)

A catalyst precursor concentrate containing 4000 wppm Mo was prepared according to the procedure for preparations F–L except that 384 g of a heavy oil blend containing 85.4 wt % material boiling above 1050° F. and 16.0 g of 20 wt. % MCB phosphomolybdic acid in phenol was employed.

Arabian vacuum residuum were charged to provide a molybdenum concentration of 250 wppm in the reaction medium. The toluene insoluble coke yield was 3.39 wt. % on 975+° F. material in the feed, which is set forth in Table II below.

TABLE II

Effect of Catalyst Precursor Concentrate Medium

| Example | Catalyst Precursor Concentrate: Preparation Number | Mo, Wppm in Concentrate | Medium Composition 1050+° F., Wt. % | Hydro-Conversion Test Run No. | Toluene Insoluble Coke, Wt. % on 975+° F. Material in Total Feed |
|---|---|---|---|---|---|
| Comparative Ex. I | F (370L) | 2000 | 1.6 | 909 | 19.64 |
| 6 | G (371L) | 2000 | 22.6 | 910 | 4.36 |
| 7 | H (378L) | 2000 | 39.3 | 930 | 3.13 |
| 8 | I (377L) | 2000 | 54.0 | 929 | 2.28 |
| 9 | J (375L) | 2000 | 64.5 | 928 | 2.24 |
| 10 | K (382L) | 2000 | 77.0 | 940 | 2.88 |
| 11 | L (383L) | 2000 | 85.4 | 941 | 2.93 |
| 12 | M (379L) | 1400 | 85.4 | 937 | 3.31 |
| 13 | N (376L) | 4000 | 85.4 | 936 | 3.39 |
| | Average of 383L, 379L, 376L | | 85.4 | — | 3.20 |

Comparative Example I and Examples 6 to 11

The catalyst concentrate preparations F–L were tested for activity in suppressing coke formation under hydroconversion conditions as follows:

To a 300 cc magnetically stirred autoclave was charged 105.0 g. of Heavy Arabian Vacuum residuum containing 85.4 wt. % material boiling above 1050° F. and 15.0 G. of the respective catalyst precursor concentrate to give a Mo concentration of 250 wppm in the reaction medium. The autoclave was pressure tested with $H_2$, vented and charged with 100 psia $H_2S$ and then pressured to 1550 psig with $H_2$. The autoclave was heated with stirring to 830° F. and maintained at this temperature for 3 hrs. During the 3 hr reaction time the pressure was maintained at 2200 psig and $H_2$flowed through the autoclave to maintain an exit gas rate of 0.26 l/min. as measured at room temperature by a wet test meter.

The autoclave was cooled and the contents washed out with 360 g. of toluene. The toluene solution was filtered to recover the toluene insoluble coke which was then dried in a vacuum oven at 160° C. for 1 hr.

The toluene insoluble coke yields for the several tests, expressed as wt. % coke on 975+° F. material in the charged feedstock (including that in the catalyst precursor concentrate), are tabulated in Table II below.

Example 12

Catalyst precursor concentrate preparation M was tested according to the procedure of Comparative Example I and Examples 6 to 11, except that 21.43 g of the catalyst precursor concentrate and 98.57 g of Heavy Arabian vacuum residuum were charged to provide a molybdenum concentration of 250 wppm in the reaction medium. The toluene insoluble coke yield was 3.31 wt % on 975+° F. material in the feed and is set forth in Table II below.

Example 13

Catalyst precursor concentrate preparation N was tested according to the procedure of Comparative Example I and Examples 6 to 11, except that 7.5 g of the catalyst precursor concentrate and 112.5 g of Heavy Example 14 (Run 1489)

To a 300 cc magnetically stirred Autoclave Engineers autoclave was charged 114.45 g. of Cold Lake residuum containing 94.84% 975+° F. material and 23.76% of Conradson carbon, together with 5.55 g. of a catalyst concentrate containing 0.4320 wt.% molybdenum prepared according to the procedure of U.S. Pat. No. 4,740,489. The catalyst concentrate was prepared in Cold Lake crude containing 53.84% 975+° F. material and 11.08% Conradson carbon. The combined mixture thus contained 200 wppm of molybdenum. The autoclave was flushed with $H_2$ then pressured to 50 psig with $H_2S$ and then to 1400 psig with $H_2$. The autoclave was then heated to 380° C. with stirring over a period of 45 minutes and held at 380°–385° C. for 20 minutes after which time a flow of $H_2$ was started such as to give effluent gas of 0.36 liter/min. as measured at atmospheric pressure by a wet test meter, and also at which time the autoclave was heated to reaction temperature over a period of 21 min. The reaction temperature of 443° C. (830° F.) was maintained with continued stirring for 3 hr. The autoclave was quickly cooled (70° C./min. for the first minute) to 150° C. whereupon the gas was vented, measured and analyzed by mass spectroscopy.

The autoclave contents were then washed from the autoclave with 360 g. of toluene and filtered to recover toluene insoluble solids. After drying in a vacuum oven at 160° C. for 1 hr. the solids weighed 3.55 g. or 2.96 wt.% on feed. The liquid filtrate was distilled to remove solvent and liquids boiling below 975° F. The 975+° F. bottoms weighed 11.9 g. and contained 61.34% Conradson carbon. This corresponds to 86.1% conversion of 975+° F. material to 975−° F. products and 60.9% conversion of Conradson carbon to 975−° F. oil plus gas. The $C_1$–$C_3$ gas yield was 10.17%. Conversions and yields are given in Table III.

Example 15 (Run 1490)

The procedure of Example 14 was followed except that 1.40 g. of a supported catalyst was also employed. The supported catalyst was comprised of 3 wt.% NiO, 18 wt.% $MoO_3$ and 3.0 wt. % P on a gamma alumina support having a surface area of 100 $m^2/g$ and a pore volume of 0.5 cc/g. The supported catalyst was sulfided and ground to a particle size less than 20 $\mu$ with most of the particles being less than 10$\mu$. In this experiment only 1.53 g. (1.28 wt.% on feed) of toluene insoluble solid was formed (excluding the supported catalyst charged) and the 975+° F. bottoms weighed 8.9 g. and contained 63.48 wt.% Conradson carbon. This corresponds to 90.3% conversion of 975+° F. material to 975−° F. products and 74.2% conversion of Conradson carbon to 975−° F. oil plus gas. The $C_1$–$C_3$ gas yield was 8.3%. Conversions and yields are given in Table III.

Comparative Example II (Run 1494)

The procedure of Example 15 was followed except that in place of the catalyst concentrate 5.55 g of Cold Lake crude containing no molybdenum was charged. In this experiment 4.62 g. (3.85 wt.% on feed) of toluene insoluble solids were formed (excluding the supported catalyst charged) and the 975+° F. bottoms product weighed 11.4 g. and contained 63.05 wt.% Conradson carbon. This corresponds to 8.56% conversion of 975° F. material to 975−° F. products and 57.5% conversion of Conradson carbon to 975−° F. on plus gas. The $C_1$–$C_3$ gas yield was 10.25%. Conversions and yields are given in Table III below.

TABLE III

| Pretreat: 380–385° C., 20 min. Run: 830° F., 3 hr., 2100# | | | |
|---|---|---|---|
| Example | Comparative Example II | 15 | 14 |
| Feed, Cold Lake Vac. Resid | 114.45 | 114.45 | 114.45 |
| FS 6180, g | | | |
| Supported Catalyst. Sulfided Powdered, g. | 1.43 | 1.40 | — |
| Cold Lake Crude, g. | 5.35 | — | — |
| Unsupported Catalyst | | | |
| Presulfided Preformed PHC Prep 133 (4320 ppm Mo) in Cold Lake Crude, g. | — | 5.55 | 5.55 |
| Mo, wppm | — | 200 | 200 |
| Toluene insoluble solids formation (excluding solid catalyst charged). wt. % on feed | 3.85 | 1.28 | 2.96 |
| 975+° F. Conv. | 85.6 | 90.3 | 86.1 |
| Con. C Conv. to 975−° F. Oil + Gas, % | 57.5 | 74.2 | 60.9 |
| $C_1$–$C_3$ Gas. Wt. % | 10.25 | 8.34 | 10.17 |

Catalyst Concentrate Preparation O (R-2226-CP)

To a 300 cc magnetically stirred Autoclave Engineer's autoclave was charged 90.0 g of a whole Cold Lake crude oil that comprised 50 wt. % of material that boiled above 975° F. The autoclave was then heated to 176° F. and, while stirring at 176° F., was injected with 10.0 grams of an aqueous solution of phosphomolybdic acid that had been prepared by dissolving 1.60 g. of Fisher's reagent-grade phosphomolybdic acid (50 wt. % Mo) in 18.40 g. deionized water. Stirring was continued at 176° F. for 10 minutes, whereupon the autoclave temperature was increased to 300° F. for a subsequent 10 minute period with nitrogen flow-through to remove water. At this point the autoclave was sealed, heated to 698°–700° F., vented, and then charged with 30 psia of $H_2S$. After an ensuing 30 min. period of stirring at 725° F., the autoclave was again vented, nitrogen flushed and cooled to room temperature. There was recovered 78.0 grams of catalyst concentrate which contained 0.51 wt. % Mo.

Catalyst Concentrate Preparation P (R-2208CP)

This catalyst concentrate preparation was carried out according to the procedure used for Preparation O, except that the charge of $H_2S$ added at 700° F. was 60 psia. There was obtained 78 g. of concentrate that contained 0.51 wt. % Mo.

Catalyst Concentrate Preparation O (R-2222-CP)

This catalyst concentrate was prepared according to the procedure used for Preparation O, except that the charge of $H_2S$ added at 700° F. was 150 psia. There was obtained 80 g. of concentrate that contained 0.50 wt. % Mo.

Catalyst Concentrate Preparation R (R-2213-CP)

This preparation was carried out according to the procedure used for Preparation O, except that $H_2S$ was not added. There was obtained 80 g. of catalyst concentrate that contained 0.50 wt. % Mo.

Example 16 (R-2227FT)

Catalyst concentrate Preparation O was tested for activity in suppressing coke formation under hydroconversion conditions as follows:

To a 300 cc magnetically stirred autoclave was charged 109.5 g. of vacuum Cold Lake resid containing 94.8 wt. % material boiling above 975° F., 5.62 g. of Whole Cold Lake crude containing 50 wt. % material boiling above 975° F. and 4.88 g of Catalyst Concentrate O to give a Mo concentration of 208 wppm in the reaction medium. The autoclave was pressure tested with hydrogen, vented and then pressured to 1350 psig at room temperature with hydrogen. The autoclave was then heated with stirring to 725° F. for a 20 minute stirred contact and then heated to 830° F. and maintained at this temperature with stirring for 3 hrs. During the three hour period the pressure was maintained at 2100 psig and H2 flowed through the autoclave to maintain an exit gas rate of 0.36 1./min. as measured at room temperature by a wet test meter.

Upon completion of the 3 hr contact the autoclave was cooled, gaseous products were vented and the remaining contents were washed out with 360 g. of toluene. The toluene wash was filtered to recover the toluene insoluble coke, which was dried at 100° C. for 2 hr. in a vacuum oven. There was recovered 1.81 g. of toluene insoluble solids, which amounted to a yield of 1.65 wt. % on the 975+° F. fraction of the feed.

Example 17 (R-2209-FT)

Catalyst Concentrate Preparation P was tested for activity in suppressing the formation of toluene insoluble coke according to the procedure described in Example 18. The reactor charge, which contained 208 wppm Mo, was made up of 109.5 g. of vacuum Cold Lake resid, 5.62 g. of whole Cold Lake Crude and 4.88 g. of Catalyst Concentrate Preparation P.

There was recovered 1.68 g. of toluene insoluble coke, which amounted to a yield of 1.53 wt. % based on the 975+° F. fraction of the reactor feed.

Example 18 (R-2223-FT)

Catalyst Concentrate Preparation Q was tested for activity according to the procedure described in Example 18. The reactor charge, which contained 208 wppm Mo, was made up of 109.5 g. of vacuum Cold Lake resid, 5.5 g. of whole Cold Lake crude and 5.0 g. of Catalyst Concentrate Preparation Q.

There was recovered 1.90 g. of toluene insoluble coke, which amounted to a yield of 1.73 wt. % on the 975+° F. fraction of the feed.

Example 19 (R-2214-FT)

Catalyst Concentrate Preparation R was tested for activity according to the procedure described in Example 18. The reactor charge, which contained 208 wppm Mo, was made up of 109.5 g. vacuum Cold Lake resid, 5.5 g. of whole Cold Lake Crude and 5.0 g. of Catalyst Concentrate Preparation R.

There was recovered 2.09 g. of toluene insoluble coke, which amounted to a yield of 1.91 wt. % on the 975+° F. fraction of the feed.

The results of the experiments described in Examples 18-21 are summarized in Table IV.

TABLE IV

| | EFFECT OF $H_2S$ PRESSURE ON CATALYST FORMATION | | |
|---|---|---|---|
| | $H_2S$ CHARGED IN CAT PREPARATION | | Toluene Insol. |
| Example No. | psia at 700° F. | Appx. $H_2S$/Mo Mole Ratio | Coke Yield, Wt. % on 975+° F. Feed |
| 19 | 0 | 0.00 | 1.91 |
| 16 | 30 | 1.81 | 1.65 |
| 17 | 60 | 3.62 | 1.53 |
| 18 | 150 | 9.05 | 1.73 |

What is claimed is:

1. A hydroconversion process for converting a heavy hydrocarbonaceous oil to lower boiling products, which process comprises the steps of:

(a) forming a mixture of a hydrocarbonaceous oil blend comprised of about 22 to about 85 wt.% of a heavy hydrocarbonaceous oil boiling above about 1050° F. with the remainder a lighter hydrocarbonaceous oil, and an oil dispersible, or decomposable, metal compound in an amount ranging from about 0.1 to about 2 weight percent, calculated as elemental metal, based on the weight of said hydrocarbonaceous oil blend, said metal being selected from the group consisting of Groups II, III, IV, V, VIB, and VIII and mixtures thereof, of the Periodic Table of the Elements;

(b) heating said mixture in the presence of a sulfiding agent at a temperature of at least about 500° F. for an effective amount of time to convert the oil-dispersible, or decomposable, metal compound to the corresponding metal-containing catalyst thereby forming a catalyst concentrate;

(c) introducing at least a portion of said catalyst concentrate into a hydroconversion zone containing a heavy hydrocarbonaceous chargestock and a supported catalyst comprised of (i) a metal selected from Groups VIB and VII of the Periodic Table of the Elements; and (ii) a refractory inorganic support material;

(d) subjecting the mixture in the hydroconversion zone to a temperature of about 700° to 900° F., in the presence of an effective amount of a hydrogen-containing gas, at a hydrogen partial pressure from about 100 to 5000 psig, thereby producing lower boiling hydrocarbonaceous products.

2. The process of claim 1 wherein the blend contains from about 30 to 85 wt. % heavier oil.

3. The process of claim 2 wherein the blend contains from about 45 to 75 wt. % heavier oil.

4. The process of claim 1 wherein said heavy hydrocarbonaceous oil of step (a) comprises a blend of a gas oil and a vacuum residuum.

5. The process of claim 1 wherein said heavy hydrocarbonaceous oil of step (a) is an atmospheric distillation residuum.

6. The process of claim 1 wherein said oil dispersible metal compound is mixed with said heavy hydrocarbonaceous oil in step (a) in an amount ranging from about 0.2 to about wt. %, calculated as elemental metal, based on said heavy oil.

7. The process of claim 1 wherein said oil dispersible metal compound is selected from the group consisting of inorganic metal compounds, salts of organic acids, organometallic compounds, salts of organic amines, and mixtures thereof.

8. The process of claim 1 wherein said metal of said oil dispersible metal compound is selected from the group consisting of molybdenum, chromium, vanadium, and mixtures thereof.

9. The process of claim 1 wherein said oil dispersible metal compound is a phosphomolybdic acid.

10. The process of claim 1 wherein the refractory inorganic support of step (b) is selected from the group consisting of alumina, silica, and alumina-silica.

11. The process of claim 1 wherein the sulfiding agent is selected from the group consisting of a hydrogen sulfide containing gaseous stream, elemental sulfur, carbon disulfide, compounds that decompose to yield sulfur moieties, and a hydrocarbon stream containing more than 0.1 wt. % sulfur.

12. The process of claim 11 wherein the sulfiding agent is a hydrogen sulfide containing gaseous stream containing at least 1 mole % hydrogen sulfide.

13. The process of claim 12 wherein the $H_2S$/metal ratio is from about 1 to 5.

14. The process of claim 1 wherein in step (a): (i) the heavy hydrocarbonaceous oil is a blend of a lighter oil boiling below about 1050° F. and a heavier oil boiling above about 1050° F. which blend contains about 22 to 85 wt. % of heavier oil, (ii) the concentration of oil dispersible metal compound is such that about 0.2 to 1 wt. % calculated is elemental metal is present, based on said oil blend.

15. The process of claim 14 wherein the oil dispersible, or decomposable, metal compound is selected from the group consisting of inorganic metal compounds, salts of organic acids, organometallic compounds, and salts of organic amines 16. The process of claim 15 wherein the metal is selected from the group consisting of molybdenum, chromium, vanadium, and mixtures thereof.

17. The process of claim 16 wherein the oil dispersible metal compound is phosphomolybic acid.

18. The process of claim 1 wherein the hydroconversion zone is comprised of one or more reactors which contain an expanded bed of the supported hydrotreating catalyst, which reactors are operated: (i) with a hydrogen flow rate of about 1,000 to 20,000 SCFB; (ii) at a liquid hourly space velocity of about 0.08 to about 1.5 volumes of chargestock per hour per volume of reactor; (iii) at a temperature from about 730° F. to about 850° F.; and (iv) at a hydrogen partial pressure of about 1,000 to about 3,000 psia.

19. The process of claim 18 wherein the sulfiding agent is selected from the group consisting of a hydrogen sulfide containing gaseous stream, elemental sulfur, carbon disulfide, and compounds that decompose to yield sulfide moieties.

20. The process of claim 19 wherein a hydrogen sulfide containing gaseous stream is used as the sulfiding agent wherein the $H_2S$/metal mole ratio is from about 1 to 5.

21. The process of claim 20 wherein the oil dispersible, or decomposable, metal compound is selected from the group consisting of inorganic metal compounds, salts of organic acids, organometallic compounds, salts of organic amines.

22. The process of claim 21 wherein the metal of the oil dispersible, or decomposable, metal compound is selected from the group consisting of molybdenum, chromium, vanadium, and mixtures thereof.

23. The process of claim 22 wherein the oil dispersible metal compound is phosphomolybdic acid.

24. The process of claim 23 wherein the refractory inorganic support material of step (c) is selected from the group consisting of alumin, silica, and alumina-silica.

* * * * *